US007789968B2

(12) United States Patent
Elick et al.

(10) Patent No.: US 7,789,968 B2
(45) Date of Patent: Sep. 7, 2010

(54) ADAPTIVE DRAIN AND PURGE SYSTEM FOR A DISHWASHER

(75) Inventors: Robert A. Elick, Jackson, TN (US); Thomas M. Johnson, Jackson, TN (US); Barry E. Tuller, Humboldt, TN (US)

(73) Assignee: Maytag Corporation, Benton Harbor, MI (US)

( * ) Notice: Subject to any disclaimer, the term of this patent is extended or adjusted under 35 U.S.C. 154(b) by 535 days.

(21) Appl. No.: 11/758,070

(22) Filed: Jun. 5, 2007

(65) Prior Publication Data

US 2007/0251544 A1 Nov. 1, 2007

Related U.S. Application Data

(60) Division of application No. 10/803,939, filed on Mar. 19, 2004, now Pat. No. 7,241,347, which is a continuation-in-part of application No. 10/186,739, filed on Jul. 2, 2002, now Pat. No. 7,146,992, which is a continuation-in-part of application No. 10/186,714, filed on Jul. 2, 2002, now Pat. No. 6,811,617.

(51) Int. Cl.
*B08B 7/04* (2006.01)

(52) U.S. Cl. ..... 134/18; 134/25.2; 134/56 D; 134/58 D

(58) Field of Classification Search ..... 134/18, 134/25.2, 56 D, 58 D, 94.1, 110, 111, 184, 134/186

See application file for complete search history.

(56) References Cited

U.S. PATENT DOCUMENTS

| | | | | |
|---|---|---|---|---|
| 5,330,580 | A | 7/1994 | Whipple, III et al. | |
| 5,957,144 | A | 9/1999 | Neff et al. | |
| 6,103,017 | A | 8/2000 | Thies et al. | |
| 6,605,157 | B2 | 8/2003 | Hegeman | |
| 6,887,318 | B2 * | 5/2005 | Bashark | 134/18 |

* cited by examiner

*Primary Examiner*—Michael Barr
*Assistant Examiner*—Saeed T Chaudhry
(74) *Attorney, Agent, or Firm*—John W. Morrison; Diederiks & Whitelaw PLC

(57) ABSTRACT

A dishwasher operates to sense the need for a drain or purge operation based on dynamic characteristics of a respective washing operation such that an adaptive system is defined. In accordance with the invention, washing fluid used to spray clean kitchenware being washed is filtered and soil from the kitchenware is collected. When the filtering system becomes clogged, a flow signal is established to indicate the need for at least a partial drain operation. Most preferably, this arrangement is used in combination with signals from a turbidity sensor, as well as pump motor current signals, to provide an comprehensive, dynamically adaptive control system.

11 Claims, 10 Drawing Sheets

ADAPTIVE DRAIN AND PURGE SYSTEM FOR A DISHWASHER

CROSS-REFERENCE TO RELATED APPLICATIONS

The present application constitutes a divisional application of U.S. patent application Ser. No. 10/803,939, issued as U.S. Pat. No. 7,241,347, entitled "ADAPTIVE DRAIN AND PURGE SYSTEM FOR A DISHWASHER" filed Mar. 19, 2004 as a continuation-in-part of U.S. patent application Ser. No. 10/186,739 entitled "DISHWASHER PUMP AND FILTRATION SYSTEM" filed Jul. 2, 2002, issued as U.S. Pat. No. 7,146,992, as well as a continuation-in-part of U.S. patent application Ser. No. 10/186,714 entitled "METHOD OF OPERATING A DISHWASHER PUMP AND FILTRATION SYSTEM" filed Jul. 2, 2002, issued as U.S. Pat. No. 6,811,617.

BACKGROUND OF THE INVENTION

1. Field of the Invention

The present invention pertains to the art of dishwashers and, more particularly, to a drain and purge system employed in a dishwasher.

2. Discussion of the Prior Art

In a typical dishwasher, washing fluid is pumped from a sump into upper and lower wash arms such that kitchenware retained on vertically spaced racks within a tub of the dishwasher will be sprayed with the washing fluid for cleaning purposes. The washing fluid is heated, filtered and recirculated. Prior to recirculating the washing fluid, the fluid is directed through one or more filters to remove soil from the fluid, with the soil being collected in a chamber. Periodically, the system will be purged in order to drain the collection chamber of the soil.

In recent years, it has become increasingly common to provide a series of straining or filtering units in connection with an overall dishwasher pumping system such that different sized soil particles are collected at varying locations. For example, a strainer can be employed to retain large soil particles, while a fine filter can be utilized to remove smaller particles. That is, the smaller particles are able to pass through the strainer, which essentially constitutes a first filtering unit, and are caught by the second or fine filter. In connection with the pumping and filtering operation, it is also known to incorporate a mincer or chopper in order to minimize soil particle size, such as just prior to a drainage operation.

Obviously, the ability of the dishwasher to thoroughly clean the kitchenware will depend on a number of factors, including the actual configuration and flow of fluid through the filtering system, as well as the manner in which pumping and draining operations are performed. For instance, as the degree of soil on the kitchenware being cleaned can significantly change between loads, the amount of soil collected in the overall dishwasher pump will be different. Correspondingly, the desirable number of drain or purge operations needed to expel the collected soil can vary. Although various dishwasher pump and filtration systems are known in the art, there still exists a need for improvements in this field in order to further enhance the overall cleaning functions performed by dishwashers, particularly in connection with determining an effective system for providing drain or purging operations based on system dynamics such that an adaptive control is established.

SUMMARY OF THE INVENTION

The present invention is directed to an adaptive drain and purge system in a dishwasher. In accordance with a preferred embodiment of the invention, an overall dishwasher pump system includes two separate pumps, one for providing a recirculation flow of washing fluid and the other being utilized during draining or purging operations. The recirculated washing fluid is directed to upper and lower wash arms for spraying kitchenware to be cleaned, while also being subjected to one or more filtering stages where the pump system filters soil from the washing fluid. The soil is directed to a collection chamber that leads to a drain port. The drain port is connected to an inlet of the drain pump. Periodically, drainage operations are performed to purge the collection chamber.

In the most preferred form of the invention, an overflow tube, which is in fluid communication with the filter chamber, extends upwardly along the rear wall of the tub basin. When a main filtering system becomes clogged, washing fluid will be forced to flow up the overflow tube. The presence of fluid in the overflow tube is sensed in order to signal the need for at least a partial drain operation. In this manner, in addition to predetermined timed drain operations, supplemental, effective drain operations can be performed during an overall wash cycle based on the dynamics of the actual cycle. Most preferably, this sensing arrangement is used in combination with signals from a turbidity sensor, as well as pump motor current signals, to provide a comprehensive, dynamically adaptive control system.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF THE PREFERRED EMBODIMENTS

Figure 1:
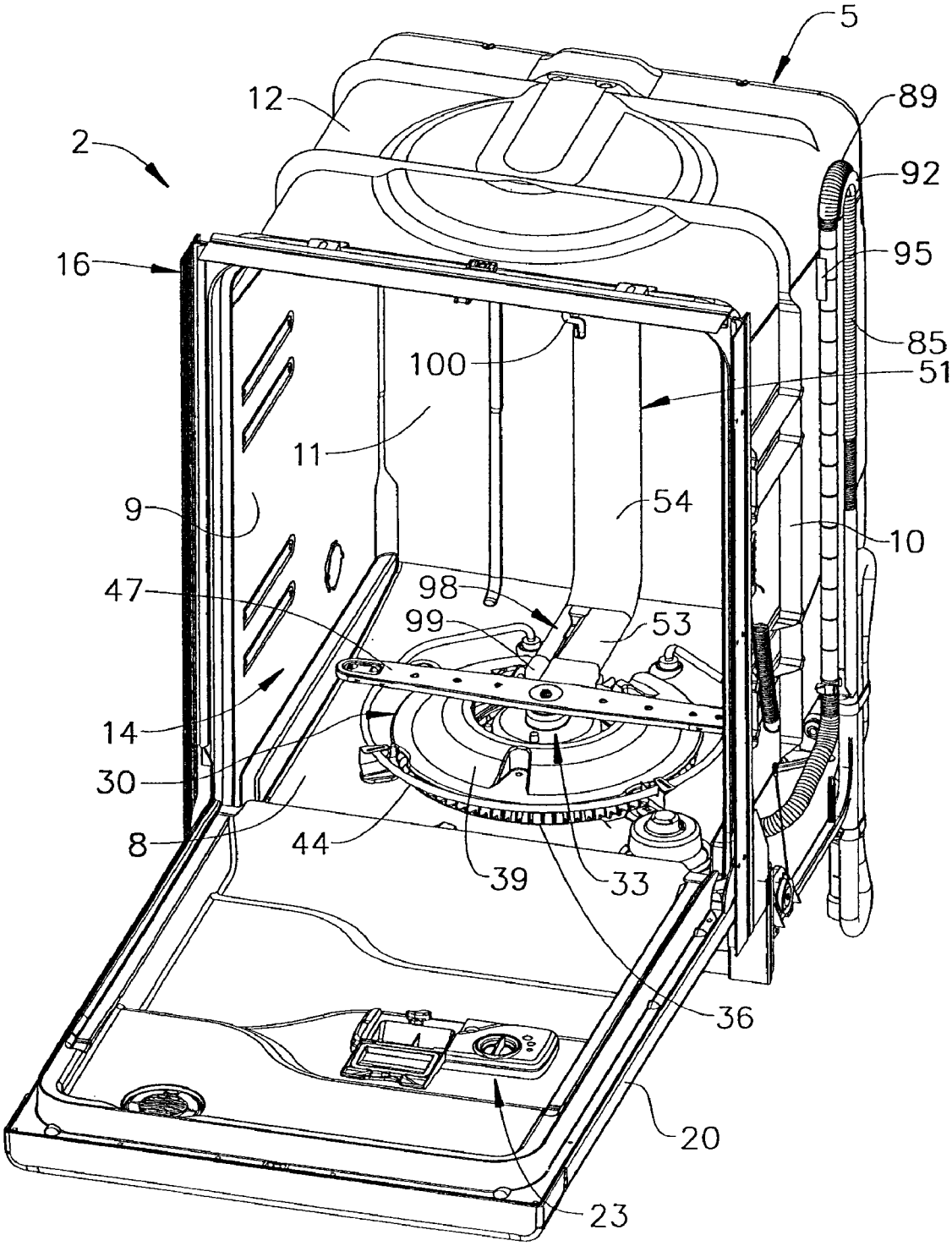
FIG. 1 is an upper right perspective view of a dishwasher constructed in accordance with the present invention, with a door of the dishwasher being open.
Figure 2:
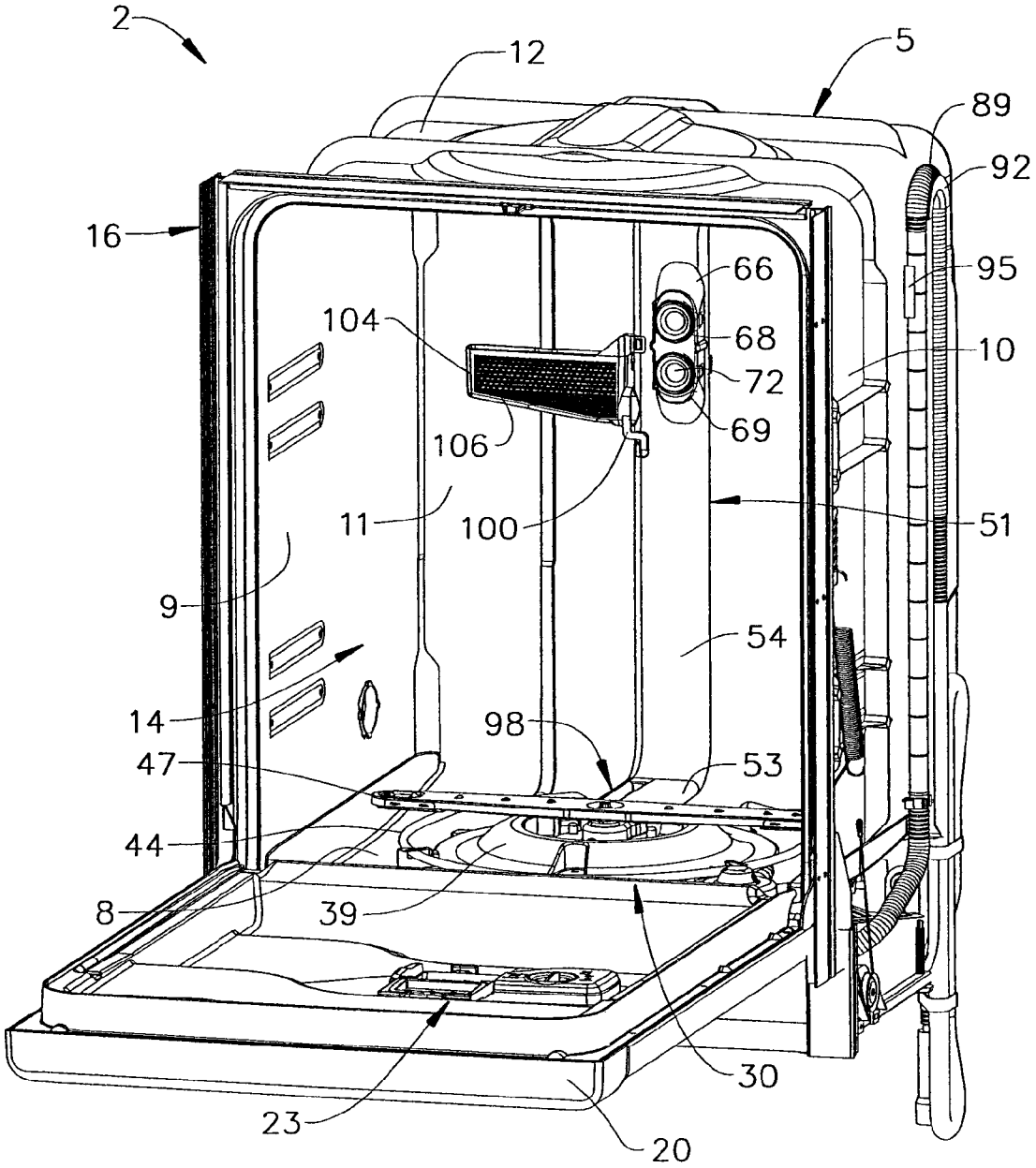
FIG. 2 is another perspective view of the dishwasher of FIG. 1 with the door open.
Figure 3:
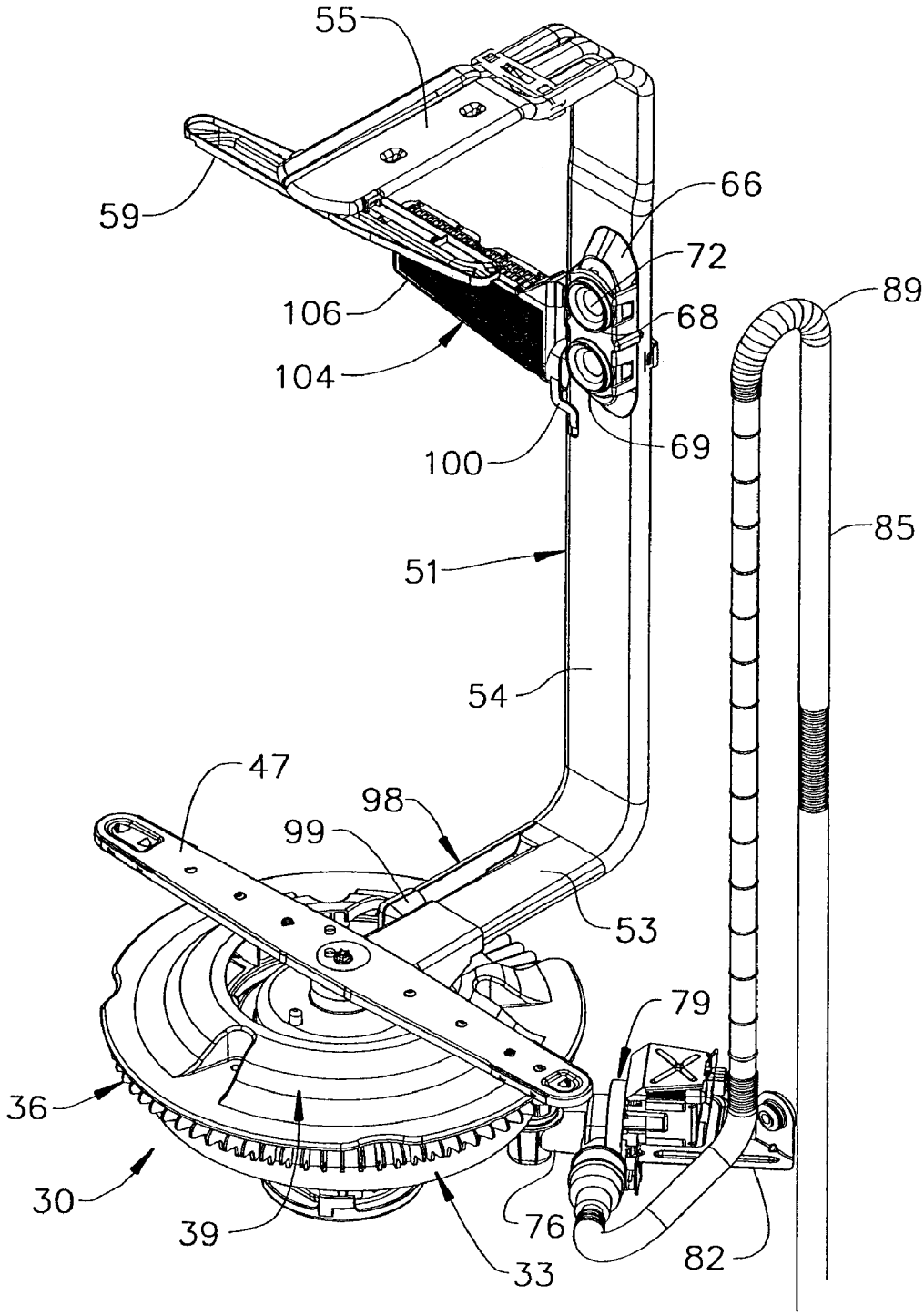
FIG. 3 is a perspective view of an overall pump and filtration system incorporated in the dishwasher of the invention.

With initial reference to FIGS. 1-3, a dishwasher constructed in accordance with the present invention as generally indicated at 2. As shown, dishwasher 2 includes a tub 5 which is preferably injection molded of plastic so as to include integral bottom, side, rear and top walls 8-12 respectively. Within the confines of walls 8-12, tub 5 defines a washing chamber 14 within which soiled kitchenware is adapted to be placed upon shiftable upper and lower racks (not shown), with the kitchenware being cleaned during a washing operation in a manner widely known in the art. Tub 5 has attached thereto a frontal frame 16 which pivotally supports a door 20 used to seal chamber 14 during a washing operation. In connection with the washing operation, door 20 is preferably provided with a detergent tray assembly 23 within which a consumer can place liquid or particulate washing detergent for dispensing at predetermined portions of the washing operation. Of course, dispensing detergent in this fashion is known in the art such that this arrangement is only being described for the sake of completeness.

Disposed within tub 5 and, more specifically, mounted within a central opening 27 (see FIGS. 4-7) formed in bottom wall 8 of tub 5, is a pump assembly 30. In the preferred embodiment and as illustrated in these figures, pump assembly 30 includes a main housing 33, an annular, radial outermost strainer 36 and a filter guard 39. A detailed description of the exact structure and operation of pump assembly 30 will be described more fully below. Extending about a substantial portion of pump assembly 30, at a position raised above bottom wall 8, is a heating element 44. In a manner known in the art, heating element 44 preferably takes the form of a sheath, electric resistance-type heating element.

In general, pump assembly 30 is adapted to direct washing fluid to at least a lower wash arm 47 and a conduit 51. As depicted, conduit 51 includes a substantially horizontal, lower section 53 extending away from main housing 33 of pump assembly 30, a vertical section 54 which generally extends along rear wall 11, and a generally horizontally extending upper section 55 which rotatably supports an upper wash arm 59. Vertical section 54 has attached thereto a wash fluid diverter 66 which defines upper and lower ports 68 and 69. Although not considered part of the present invention, each of upper and lower ports 68 and 69 has associated therewith a valve, such as a flapper element indicated at 72, for preventing any water flowing through conduit 51 from exiting either of port 68 or 69 unless structure is inserted into a respective port 68, 69 so as to deflect a respective flapper element 72. In general, wash fluid diverter 66 can actually be formed with a varying number of ports ranging from 1 to 3 or more. The overall wash fluid diverter 66 is actually designed to cooperate with a vertically adjustable upper rack (not shown) which would carry an associated underside wash arm and respective piping that would become aligned with and project into a respective port 68, 69 in order to deflect flapper element 72 so as to provide an additional wash arm used to further spray washing fluid upon kitchenware, thereby supplementing lower wash arm 47 and upper wash arm 59 during a washing operation within dishwasher 2. In general, vertically adjustable racks, as well as multi-port wash fluid diverters are known in the art such that this structure will not be described further here.

Pump assembly 30 has associated therewith a drain port 76 to which is attached a drain pump 79. Drain pump 79 is secured beneath bottom wall 8 of tub 5 through the use of a suspension bracket 82. Drain pump 79 has associated therewith a drain hose 85 including at least one corrugated or otherwise curved portion 89 that extends about an accurate hanger 92 provided on an outside surface of side wall 10. Drain hose 85 is also preferably secured to tub 5 through various clips, such as that indicated at 95. In any event, in this manner, an upper loop is maintained in drain hose 85 to assure proper drainage in a manner known in the art.

Also projecting from main housing 33 of pump assembly 30 is an overflow tube 98. More specifically, overflow tube 98 includes a first end 99 leading from main housing 33 in a manner which will be detailed more fully below, as well as a second end 100 which leads into an overflow housing 104. In accordance with the preferred embodiment shown in these drawings, overflow tube 98 is preferably integrated into conduit 51 during manufacturing, such as through a blow molding or extrusion operation. In any event, second end 100 of overflow tube 98 leads out of the overall structure defining conduit 51 to direct fluid from within overflow tube 98 into overflow housing 104. Overflow housing 104 incorporates a coarse filter 106. In one preferred embodiment, filter 106 has openings in the order of 20 mils. Although a removable cover could be provided to access filter 106 for replacement/cleaning purposes, filter 106 is preferably molded into housing 104 such that the entire housing/filter unit would be replaced if necessary. However, as will be detailed further below, a backwashing arrangement for filter 106 is preferably employed for cleansing purposes. In any event, further details on the construction and operation of this overflow arrangement will be provided below in describing the overall operation of pump assembly 30.

Figure 4:
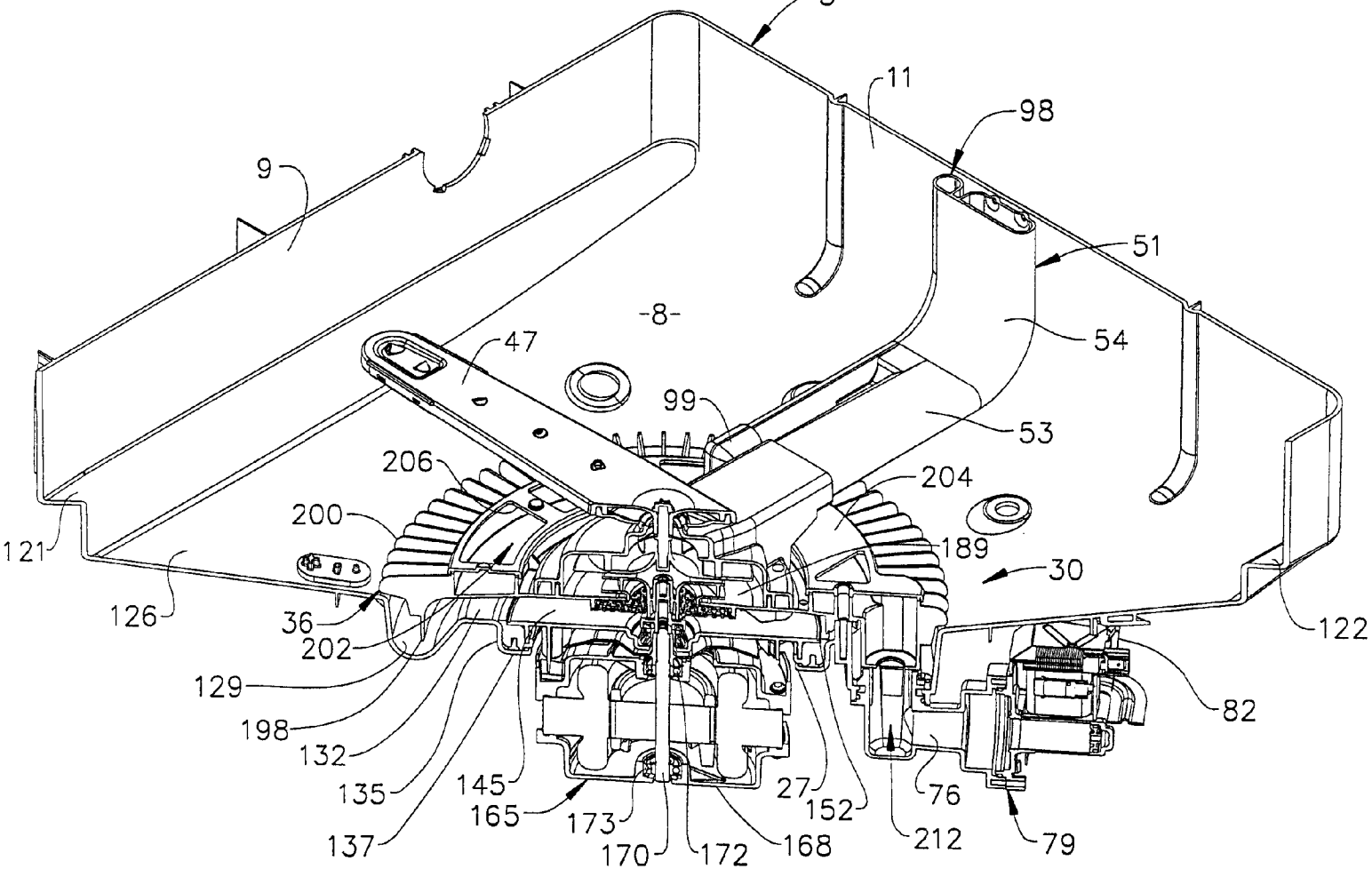
FIG. 4 is an isometric, cross-sectional view through both a tub basin and the overall pump and filtration system of the dishwasher of FIG. 1.

At this point, reference will now be made to FIGS. 4-7 in describing further details of pump assembly 30, as well as other components of dishwasher 2. As best shown in FIG. 4, side walls 9 and 10 lead into bottom wall 8 through a pair of spaced plateau portions 121 and 122. Rollers for a lower rack (not shown) are adapted to be supported upon plateau portions 121 and 122 for movement of the rack into and out of tub 5. In any event, bottom wall 8 includes a lower base portion 126 which slopes inwardly towards a trough 129. Trough 129 defines an inlet trap which is generally U-shaped in cross-section as clearly shown in each of FIGS. 4-7. Radially inwardly of trough 129, bottom wall 8 includes an inner radial plateau portion 132 that leads to a downwardly extending portion 135 and finally a substantially horizontally extending innermost portion 137. Innermost portion 137 defines central opening 27 within which pump assembly 30 extends as clearly shown in these figures.

Pump assembly 30 includes a lower housing plate 145 that includes a central recess section 148 and an outer edge 152. Spaced slightly inwardly from outer edge 152, lower housing plate 145 is provided with a lower rib 155. As shown, lower rib 155 extends into a notch (not labeled) defined in a seal 160. More specifically, seal 160 is sandwiched between downwardly extending portion 135 and lower rib 155, while also projecting along outer edge 152. In this manner, fluid that flows through trough 129 and along inner-radial plateau portion 132 is prevented from reaching innermost portion 137, but rather is forced to flow above lower housing plate 145.

Pump assembly 30 has associated therewith a motor 165. In general, motor 165 is of the type known in the art and includes a housing 168 and an associated driveshaft 170 which is rotatably supported by housing 168 through upper and lower bearing units 172 and 173. Since the general construction and operation of motor 165 is known in the art, it will not be detailed further herein. However, it should be noted that driveshaft 170 is secured for concurrent rotation with a lower drive sleeve 174, which is spaced from an upper sleeve 175. Although not shown in detail, lower drive sleeve 174 is preferably formed of two parts which securely sandwiches a chopper blade 178 therebetween. In this manner, chopper blade 178, which extends substantially parallel to but spaced vertically above lower housing plate 145, rotates in unison with driveshaft 170 during operation of motor 165. Arranged above chopper blade 178 is a fixed, apertured plate 182. As clearly shown in at least FIGS. 4 and 5, plate 182 actually includes a plurality of spaced holes 184 which are sized to permit only predetermined sized particles entrained within washing fluid as will be detailed more fully below.

Figure 5:
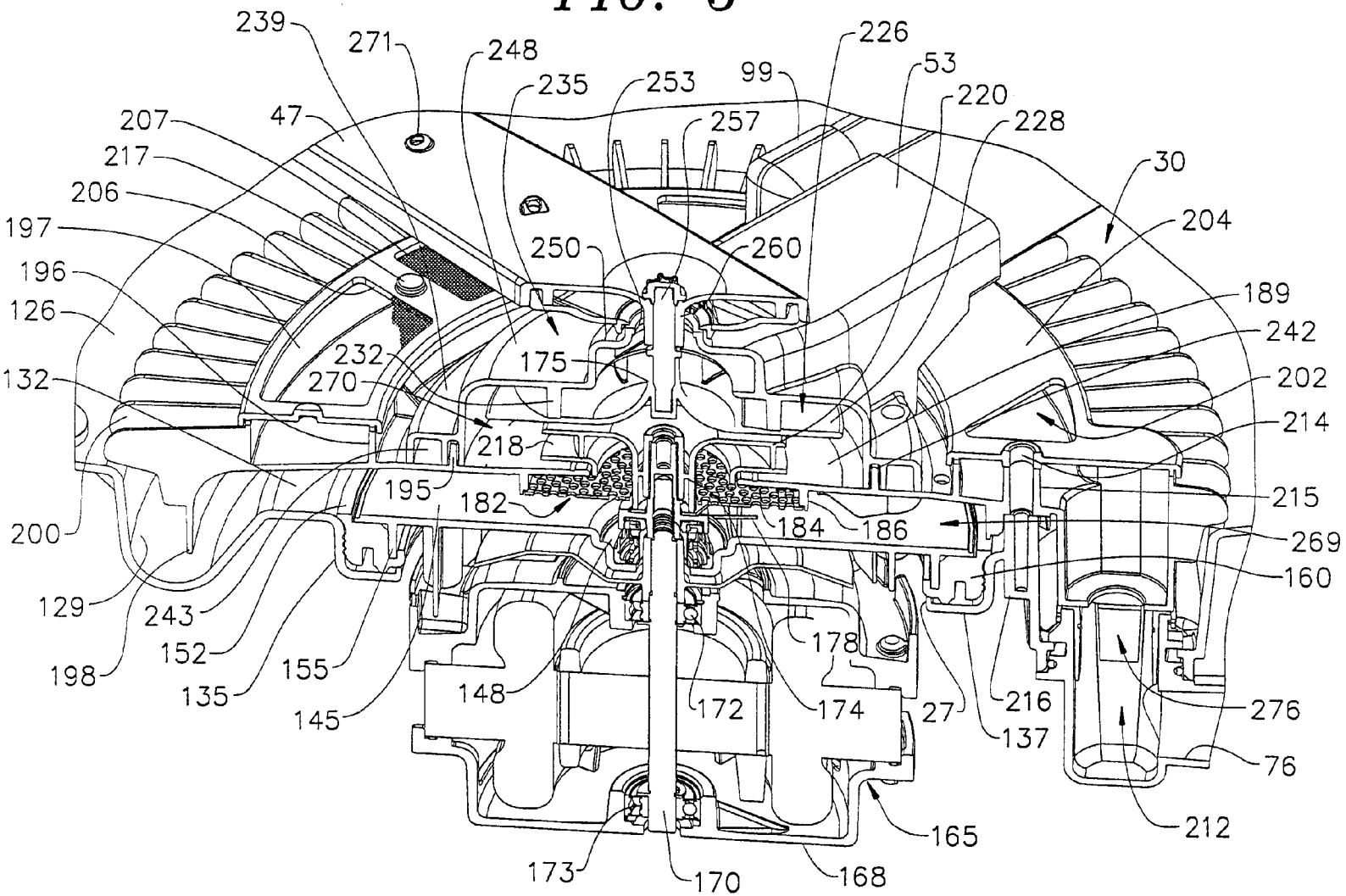
FIG. 5 is a perspective, cross-sectional view through the tub basin and the pump/filtration system.

At this point, it should be noted that apertured plate 182 is actually secured to an annular rib 186 which projects downward from an intermediate housing plate 189. Actually, intermediate housing plate 189 has arranged radially outward of annular rib 186 a plurality of annularly spaced bosses, one of which is indicated at 193 in FIG. 7, for securing fixed apertured plate 182 in a desired position. Intermediate housing plate 189 also includes a series of upstanding, radially spaced ribs 195-197 which project in a direction opposite to annular rib 186, as well as an additional rib 198 which extends downward from intermediate housing plate 189. For reasons which will be discussed more fully below, rib 198 actually defines a flow plate which projects into trough 129. Ribs 196 and 197 extend upwardly substantially parallel to one another and define a filter chamber 202. A cover 204, which includes a plurality of enlarged openings 206, spans across ribs 196 and 197. As best illustrated in FIGS. 4 and 5, each of enlarged openings 206 has associated therewith a fine mesh screen 207, preferably having openings in the order of 75 microns or 3 mils, for filtering purposes. Filter chamber 202 is open, at one side of pump assembly 30, to a collection chamber 212. This arrangement is best shown in FIGS. 4 and 5, with these figures also indicating the manner in which cover 204 is secured to intermediate housing plate 189 as well as bottom wall 8.

More specifically, cover 204 is provided with various annularly spaced holes, one of which is indicated at 214 aligned with a respective upstanding sleeve 215 projecting up from intermediate housing plate 189, as well as a respective mounting boss 216 formed integral with bottom wall 8. Upon aligning these components in this manner, mechanical fasteners, such as that indicated at 217, are placed through a respective hole 214 and sleeve 215 and secured within respective bosses 216. In any event, at this point, it is merely important to note that filter chamber 202 extends about a top portion of pump assembly 30 and is in fluid communication with collection chamber 212 which, as will be discussed more fully below, is in fluid communication with drain port 76 and drain pump 79.

Figure 6:
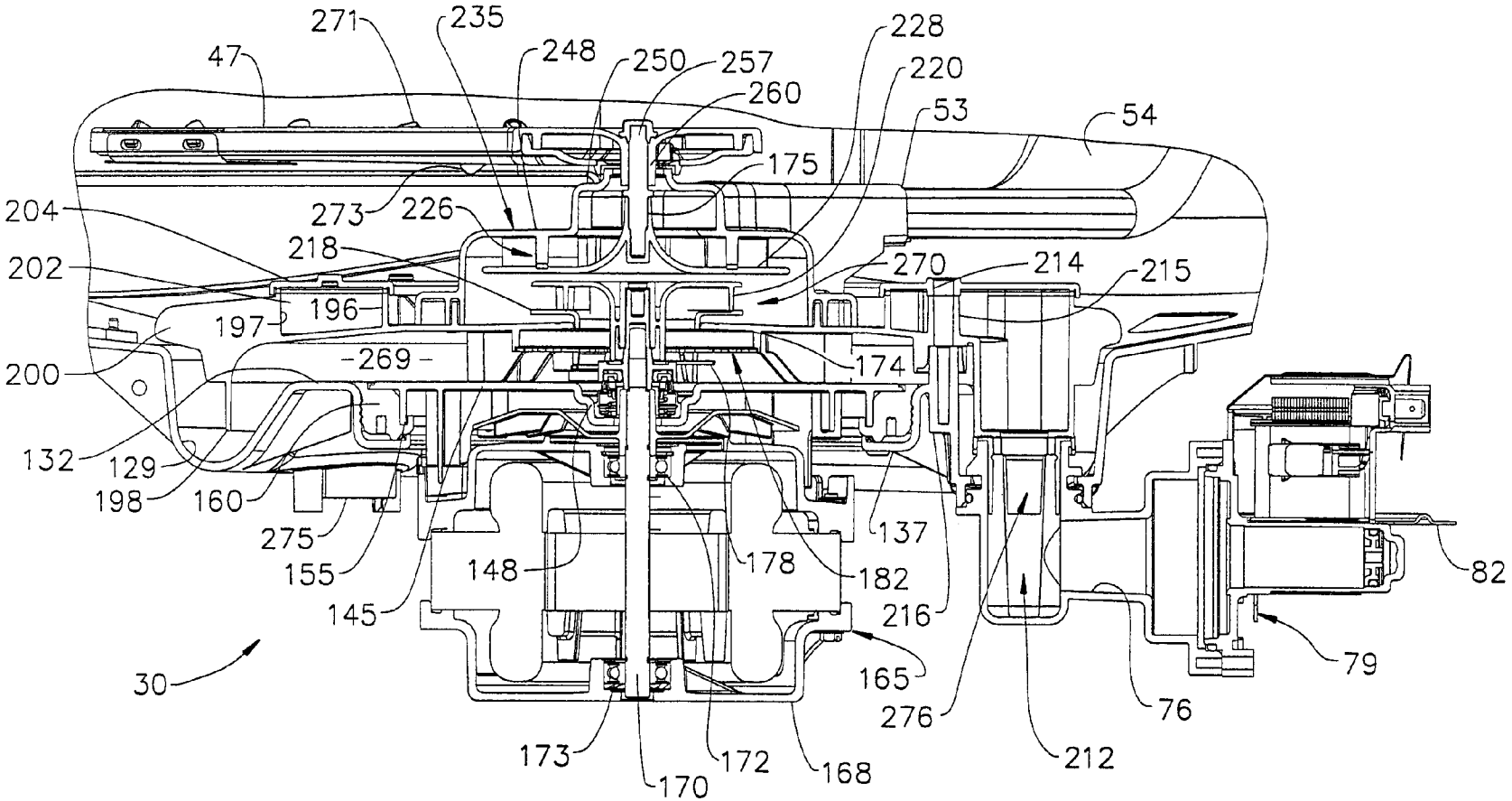
FIG. 6 is an elevational, cross-sectional view through the tub basin and the pump/filtration system.

With further reference to each of FIGS. 4-6, intermediate housing plate 189 locates a pump component indicated at 218. Rotating with pump component 218 is another pump component or impeller 220. As shown, impeller 220 is also spaced from upper sleeve 175. In any event, impeller 220 is drivingly connected to driveshaft 170 so as to rotate in unison with driveshaft 170 and chopper blade 178 during operation of motor 165. Although further details will be provided below, at this point, it should be noted that components 218 and 220 collectively define a recirculating pump incorporated in the overall pump assembly 30.

Figure 7:
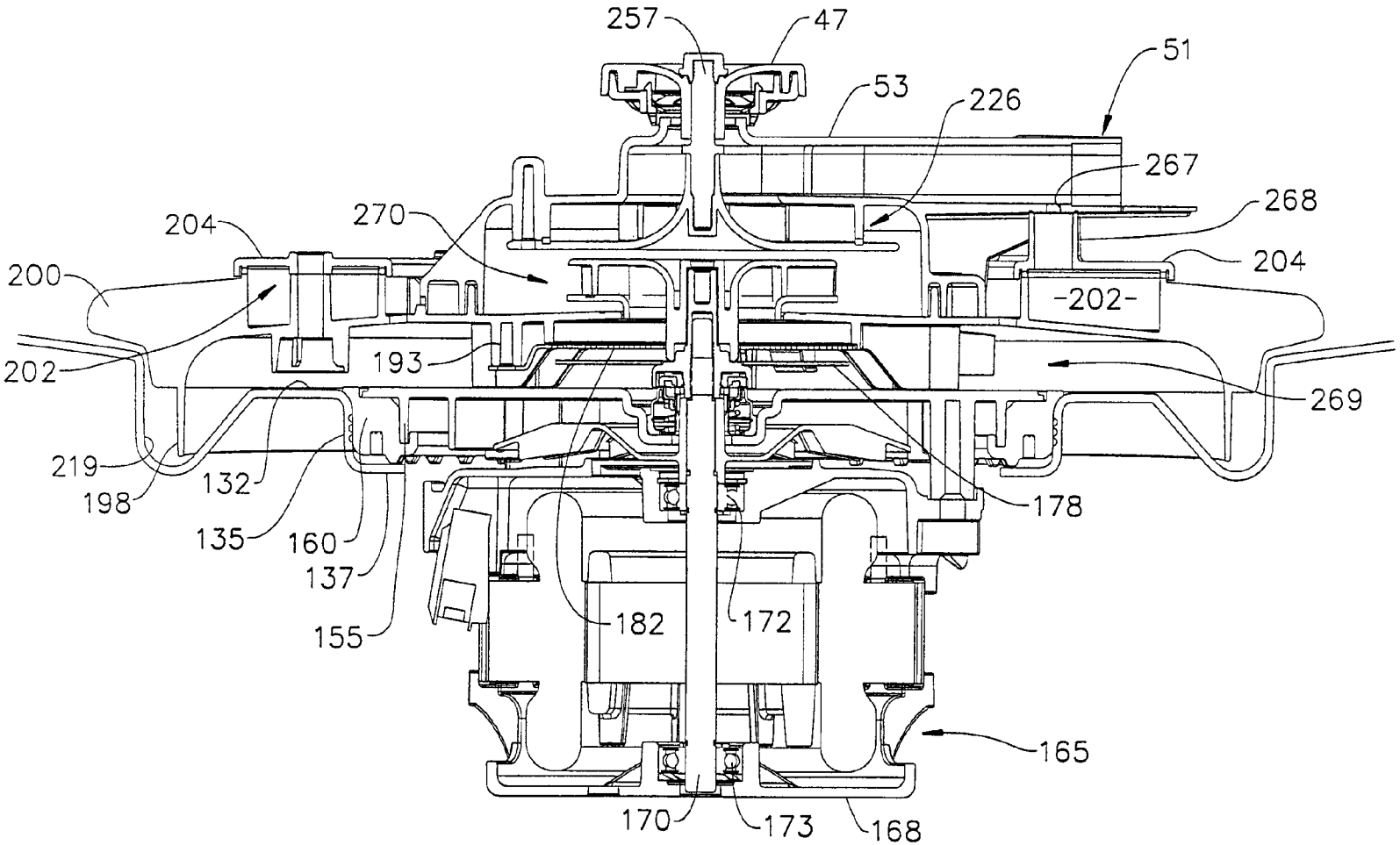
FIG. 7 is another elevational, cross-sectional view through the tub basin and the pump/filtration system.
Figure 8:
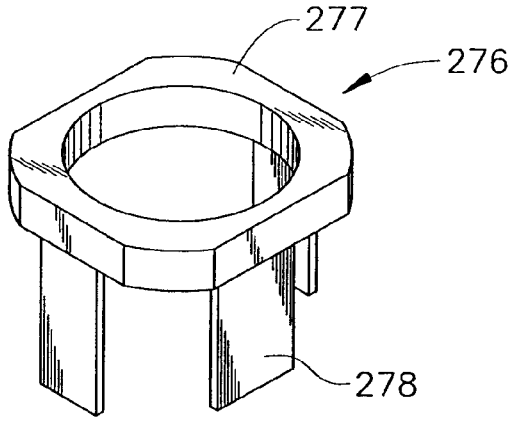
FIG. 8 is a perspective view of a flapper valve incorporated in the pump and filtration system of the invention.

In accordance with the most preferred embodiment, arranged above impeller 220 is a fixed involute manifold 226. Involute manifold 226 is shown to include a first involute member 228 and a second involute member 232 which are intermeshed in a manner defining a radially spiraling chamber. Second involute member 232 is preferably formed as part of a pump housing cap 235 having an outermost radial portion 239 provided with at least one annular recess 242 into which projects rib 195 of intermediate housing plate 189. A second annular recess 243 is defined radially outwardly of annular recess 242 as clearly shown in these figures. In any event, it is merely important to note that pump housing cap 235 is fixed to intermediate housing plate 189 with at least the positioning of rib 195 in annular recess 242 creating a seal between these members. In the embodiment shown, pump housing cap 235 actually includes an outermost radial portion, i.e., a lower region 239 that defines annular recesses 242 and 243, an intermediate region 248 defining second involute member 232, and an upper region 250 provided with a central opening 253. A shaft 257 which is secured to first involute member 228 extends through both opening 253 and a sleeve 260 formed integral with lower wash arm 47 in order to rotatably support lower wash arm 47. As also illustrated in these figures, upper region 250 also opens into lower section 53 of conduit 51. As best shown in FIG. 7, prior to vertical section 54, conduit 51 is formed with a sampling port 267 which opens into a cylinder member 268 formed as part of cover 204. In turn, cylinder member 268 leads into filter chamber 202.

The manner in which fluid and entrained particles flows through pump assembly 30 during operation of dishwasher 2 will now be described. In a manner known in the art, tub 5 will be initially, partially filled with water which can be further heated by activation of heating element 44. During a washing cycle, motor 165 is activated in order to concurrently rotate chopper blade 179 and impeller 220. In this manner, the washing fluid with entrained particles will be drawn into trough 129 between fins 200 of strainer 36. Given the distances between the respective fins 200 of strainer 36, any large food pieces, utensils or the like will be caught by strainer 36 in the bottom of tub 5 instead of entering pump assembly 30 where they may cause damage. The combination of strainer fins 200 and rib or flow plate 198 establishes the flow and the size of entrained soil particles which can enter pump assembly 30. Therefore, this washing fluid, which will initially be substantially clean but which will certainly pick-up additional soil during at least initial stages of a washing operation, will flow past strainer fins 200, down into trough 129, beneath flow plate 198, up an opposing portion of trough 29 to an intake chamber 269 defined between lower housing plate 145 and intermediate housing plate 189.

As the washing fluid is being drawn in by at least the operation of impeller 220, the washing fluid will attempt to flow through apertured plate 182. At this point, the rotating chopper blade 178 will function to mince any entrained particles within the washing fluid, with the particles having to be chopped sufficiently in order to enable passage through apertured plate 182. Therefore, flowing through apertured plate 182 will be a liquid having, at most, small soil particles entrained therein. When this fluid supply is directed between pump component 218 and impeller 220, the fluid is directed radially outwardly into a pumping chamber 270. The fluid is then forced to reverse direction and to flow through involute manifold 226.

Therefore, at involute manifold 226, the fluid is directed radially inwardly and then upwardly, with a portion of the fluid flowing through to and causing rotation of lower wash arm 47 and a substantial portion of the fluid being directed into conduit 51. The portion of fluid flowing into lower wash arm 47 will be sprayed into tub 5 through nozzles, such as that indicated at 271, provided on lower wash arm 47 in order to direct the fluid upwardly against kitchenware supported upon a lower rack, as well as a portion of the fluid downwardly as will be discussed more fully below.

With respect to the fluid flowing through conduit 51, a small percentage of this fluid will enter sampling port 267 so as to be directed through cylinder member 268 and into filter chamber 202. The remaining portion of the fluid in horizontal section 53 of conduit 51 will continue to flow through vertical section 54 and upper horizontal section 55 in order to reach upper wash arm 59 which is used to provide a downward flow of washing fluid onto the kitchenware. As indicated above, a portion of the fluid flowing through conduit 51 can also be diverted through a respective port 68, 69 through the use of wash fluid diverter 66.

The portion of the fluid that flows into filter chamber 202 will actually be forced to flow around filter chamber 202 which is open to collection chamber 212 and drain port 76. However, when drain pump 79 is not activated, this fluid and the entrained particles therein can only initially fill up collection chamber 212 and filter chamber 202. Once chambers 202 and 212 are filled, the fluid will be caused to flow out of pump housing 33 and back into tub 5 through the various enlarged openings 206 provided with fine mesh screen 207. Of course, given the presence of fine mesh screen 207, the fluid re-entering tub 5 from filter chamber 202 will be substantially cleansed of any soil having any substantial particulate size. Any soil particles which are larger than that which can flow through screen 207 will be forced to remain within filter chamber 202 and will actually find their way into collection chamber 212 due to the current flow created by incoming fluid into filter chamber 202 through sampling port 267 and gravity. In any event, this cleansed washing fluid will be mixed with the remaining fluid in tub 5 and, in fact, re-mixed with the re-circulated fluid flowing out at least lower wash arm 47 and upper wash arm 59.

With this arrangement, continued recirculation of washing fluid will assure that all of the soil particles are finely chopped by blade 78 as all the washing fluid entering intake chamber 269 can only pass to pumping chamber 270 through chopper blade 178 and fixed apertured plate 182. Furthermore, by continuing to provide a flow into sampling port 267 and further finely filtering particles entrained in this fluid by means of fine mesh screen 207, the percentage of soil in the recirculated washing fluid actually becomes quite small. Of course, soil will be accumulating within collection chamber 212, along with a certain percentage in filter chamber 202. Furthermore, since the fluid is attempting to exit pump assembly 30 through fine mesh screen 207, the underside of fine mesh screen 207 itself will actually start to accumulate soil and can become clogged. For this purpose, lower wash arm 47 is provided with one or more lower nozzles, one of which is indicated at 273 in FIG. 6, in order to direct a spray of washing fluid onto fine mesh screen 207. Therefore, this directed flow will tend to wash particles off of fine mesh screen 207 and back into filter chamber 202 and, eventually, to collection chamber 212.

Regardless of this arrangement, fine mesh screen 207 can become significantly clogged so as to undesirably reduce the flow of cleansed washing fluid therethrough. Obviously, such a clogged arrangement results in an increase in pressure within filter chamber 202. Granted, a substantial increase in pressure could cause washing fluid to flow into drain hose 85 upon exceeding a drain loop head. However, this increased pressure forces washing fluid to flow from within filter chamber 202 into overflow tube 98, which is in direct fluid communication with filter chamber 202 as perhaps best shown in FIGS. 4 and 5. Therefore, washing fluid from filter chamber 202 is forced up overflow tube 98 towards overflow housing 104. At this time, coarse filter 106 will function to at least limit the return of soil back into tub 5 until fine mesh screen 207 is cleansed as discussed further below.

In accordance with the most preferred embodiment of the invention, complete drainage operations are performed on a preprogrammed, timed basis. However, additional drain or purging operations can also be performed. In accordance with the invention, an initial drainage sequence is established depending on the dishwashing operation set by the user. For instance, if the user selects a normal wash mode, a fill operation will be performed wherein a certain amount of water, which will vary with dishwasher models (generally in the order of 6.5-8 quarts), is introduced into tub 5. Thereafter, a main wash cycle will be entered. In accordance with the most preferred form of the invention, the main wash cycle is set at 34 minutes. The main wash cycle is then followed by a rinse cycle lasting 25 minutes. Thereafter, a 30 minute dry cycle is entered.

In the alternative, the user could select a dirty wash cycle which would result, for example, in an 8 minute pre-wash, followed by: a 28 minute main wash cycle, a pre-rinse of 10 minutes, a main rinse of 25 minutes, and a 30 minute drying period. With these configurations, the normal and dirty wash cycles would have 2 or 4 fill periods respectively. Correspondingly, there would be 2 or 4 drain operations performed, each being approximately 2 minutes in duration. Therefore, the drainage operations are pre-programmed based on the particular washing cycle selected, i.e., provided at specific lapsed time periods during an overall dishwashing operation. However, it is possible for a user to select a normal wash mode when the amount of soil on the kitchenware justifies operation under a dirty or heavy soil mode. To this end, dishwasher 2 includes a turbidity sensor 275 shown mounted beneath tub 5 while projecting into washing chamber 14, preferably in trough 129. Of course, the use of turbidity sensors to sense soil levels in dishwashers is widely known in the art. In accordance with the present invention, if a normal wash cycle is selected but turbidity sensor 275 indicates high soil levels, the pre-programmed dirty wash cycle operational sequence will be followed. Furthermore, turbidity sensor 275 incorporates a thermistor (not separately labeled) which is used in cycling of heater element 44. At this point, it should be noted that the location of turbidity sensor 275 within trough 129 is considered to be an advantageous feature as turbidity sensor 275 is more sensitive to turbulences developed by existing soil. Trough 129 actually functions as an air/water separator for pump assembly 30 such that the location of turbidity sensor 275 is also considered to enhance the accuracy of soil level signals.

In any case, during full or partial drainage operations, soil will be removed from at least collection chamber 212 when a combination of soil and washing fluid will be directed, through the operation of drain pump 79, into drain hose 85. During this time, it is preferred to continue the operation of pump assembly 30 in order that nozzles 273 can continue to enhance the cleaning of fine mesh screen 207. In addition, following the last drain operation in a given dishwashing cycle, a spritzing step is preferably performed wherein a small amount of water is introduced to fill up trough 129 in order to ensure that turbidity sensor 275 remains covered so that a film will not develop thereon.

Washing fluid will continue to be pumped into drain hose 85 while fine mesh screen 207 is being purged of food soil, at which time the washing fluid in overflow tube 98 will drop back down to a normal level. Given the inclusion of filter 106 in overflow housing 104, only filtered washing fluid can enter tub 5 through overflow tube 98. In the most preferred embodiment, filter 106 actually incorporates a coarse mesh screen versus the fine mesh screen 207. Again, it should be realized that fine mesh screen 207 can become overwhelmed with food soil, particularly during pre-washes. However, coarse filter 106 performs a similar filtering function when the washing fluid with entrained soil is forced up overflow tube 98. When a washing or rinsing operation is being performed by dishwasher 2, it is preferred that a certain spray percentage be directed at filter 106, such as through the angling of a number of nozzles on upper wash arm 59 or on an intermediate, rack supported wash arm (not shown). Therefore, any soil that collects in filter 106 is washed back down overflow tube 98. When pump 30 remains activated during a drain operation, this flow of soil to drain is advantageously enhanced. During other cycles, the washing fluid sprayed on filter 106 will eventually cause collected soil to fall back to filter chamber 202 through overflow tube 98 due to gravity. There the soil would be separated from the washing fluid by fine mesh filter 207.

During drain operations, certainly soil retained in collection chamber 212, along with some of washing fluid within pump assembly 30, will be expelled. However, not all the drainage must flow through intake and pumping chambers 267 and 270 in accordance with the invention. That is, it is desirable to have some direct fluid communication between tub 5 and drain pump 79. This communication is preferably performed through the incorporation of a flapper valve 276 which is arranged in collection chamber 212 as shown in FIGS. 4-6 and 8. In accordance with the embodiment shown, flapper valve 276 includes an upper rim portion 277 and a plurality of downwardly directed flaps or legs 278. Actually, three legs 278 are shown in the preferred embodiment, with each of legs 278 constituting a wall section of collection chamber 212, while being arranged in trough 129. With this arrangement, when drain pump 79 is activated, the suction created in collection chamber 212 will deflect legs 278 closer together thereby permitting washing fluid from within tub 5 to directly enter collection chamber 212 and, subsequently, drain hose 85.

More specifically, the inclusion of flapper valve 276 provides a preferential drain for collection chamber 212 and filter chamber 202 before the sump defined by tub 5. That is, when a drain operation is performed, the initial flow of washing fluid and soil from filter and collection chambers 202 and 212 will prevent legs 278 from deflecting inward, i.e., the flow past legs 278 tends to keep legs 278 closed against sides of collection chamber 212. Once this soil entrained fluid is drained, legs 278 will deflect inward to allow further draining of the washing fluid from tub 5. Therefore, when legs 278 deflect inward, slots are created to allow flow to drain port 76. During normal washing and rinsing operations, flapper valve 276 also advantageously prevents collected soil from returning to tub 5 about legs 278 when fine mesh screen 207 becomes clogged as an increase in pressure within filter chamber 202 will actually result in an outward biasing of legs 278. To this end, flapper valve 276 can substantially enhance the effectiveness of potential, partial purging operations which really only require draining to occur until the point when legs 278 will deflect inward.

Figure 9:
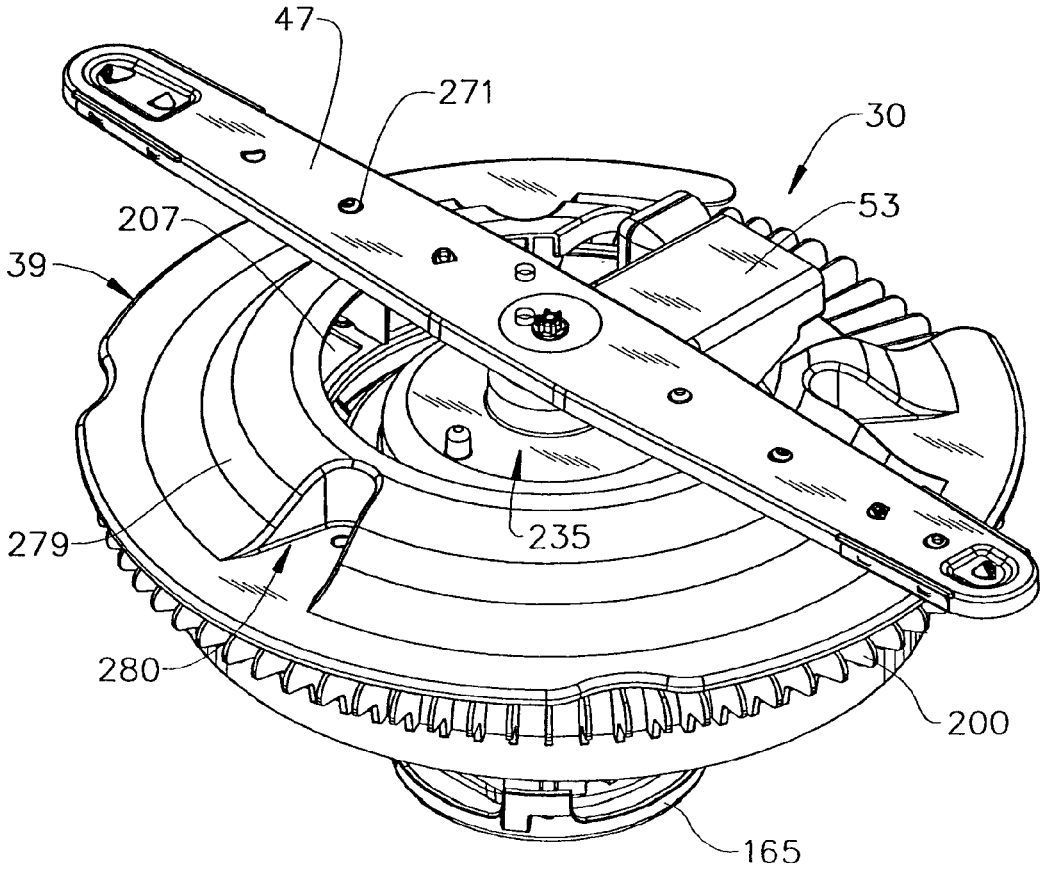
FIG. 9 is an enlarged, perspective view of the recirculation pump, along with the lower wash arm, shown in the overall system of FIG. 3.
Figure 10:
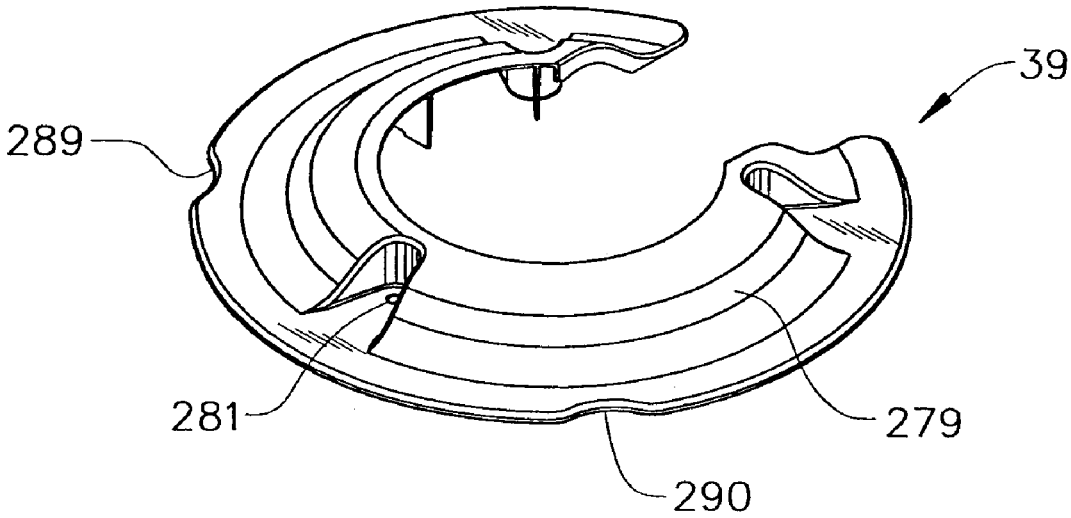
FIG. 10 is an upper perspective view of a filter guard shown mounted atop the recirculation pump in FIG. 9.
Figure 11:
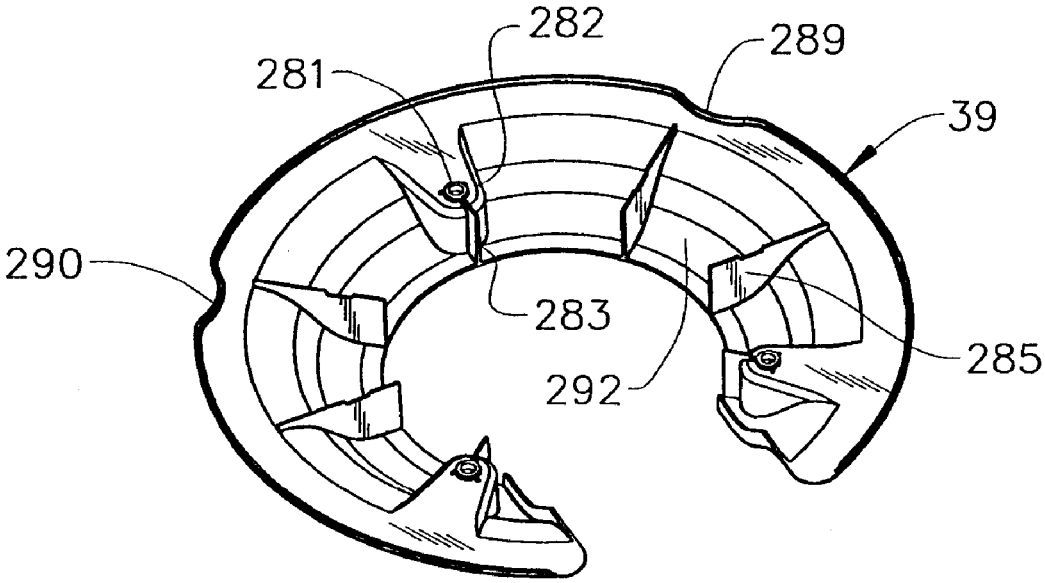
FIG. 11 is a lower perspective view of the filter guard of FIG. 9.

FIGS. 9-11 will now be referenced to describe the preferred construction and function of filter guard 39. Although filter guard 39 is illustrated in each of FIGS. 1-3, this structure has been removed from FIGS. 4-7 to clearly depict other structure associated with pump assembly 30. In any event, as shown, filter guard 39 is mounted upon main housing 33 below lower wash arm 47. Filter guard 39 includes an outer wall 279 which slopes from an inner radial portion towards an outer radial portion. As depicted, filter guard 39 actually extends substantially over strainer fins 200 but, more importantly, extends entirely over fine mesh screen 207. In essence, without the presence of filter guard 39, utensils and other objects could inadvertently fall within tub 5 and damage fine mesh screen 207. Therefore, filter guard 39 is provided to shield fine mesh screen 207, while outer wall 279 is angled to accommodate run-off of any washing fluid.

As clearly shown in these figures, the outer wall 279 of filter guard 39 is provided with various wash-out regions 280, with these wash-out regions also having associated therewith mounting holes 281 in bosses 282 for securing filter guard 39 to main housing 33. Further, along an underside of filter guard 39 at wash-out regions 280 are a plurality of ribs 283. In addition, between adjacent bosses 282 are provided spacer ribs 285. Indentations or recesses 289 and 290 are provided around the periphery of filter guard 39, with recesses 289 and 290 being essentially located at mounting locations for heating element 44 as clearly illustrated in FIG. 1.

In a manner commensurate with outer wall 279, filter guard 39 has an underside 292 which curves in order to enhance the directing of wash arm spray for the backwashing of fine mesh screen 207. That is, as previously indicated, lower wash arm 47 includes at least one set of nozzles 273 for use in directing a spray to backwash and cleanse fine mesh screen 207. Filter guard 39 is spaced sufficiently from pump housing cap 235 and nozzles 273 are suitably angled to accommodate this spray upon fine mesh screen 207. However, the curvature of underside 292 further enhances this backwashing function. Wash-out regions 280 are provided for flushing out trapped food particles in connection with the overall filter guard 39.

Figure 12:
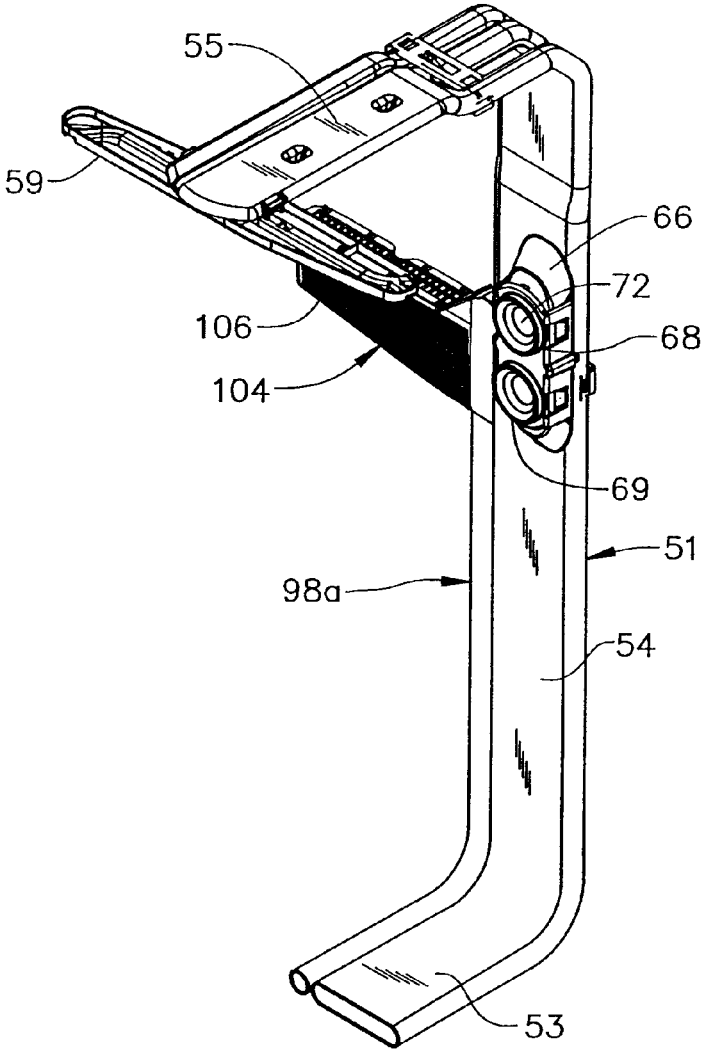
FIG. 12 is a perspective view of a modified water conduit and overflow tube arrangement for the dishwasher of FIG. 1.

Although overflow tube 98 is shown to be integrated into conduit 51, it is possible to provide a separate overflow tube **98*a* (see FIG. 12). Tube 98*a* is shown to extend adjacent to conduit 51, but actually could be directed to another portion within tub 5 distinct from conduit 51. That is, where conduit 51 extends generally along a central portion of rear wall 11, it is possible to direct overflow tube 98*a* to a corner or side of tub 5. Such an arrangement could enhance the accessibility to filter 106** if changing thereof is warranted. In addition, other forms of overflow relief could also be employed with the invention, such as that disclosed in U.S. patent application Ser. No. entitled "Dishwasher Pump and Filtration System" filed on even date herewith and incorporated by reference.

Figure 13:
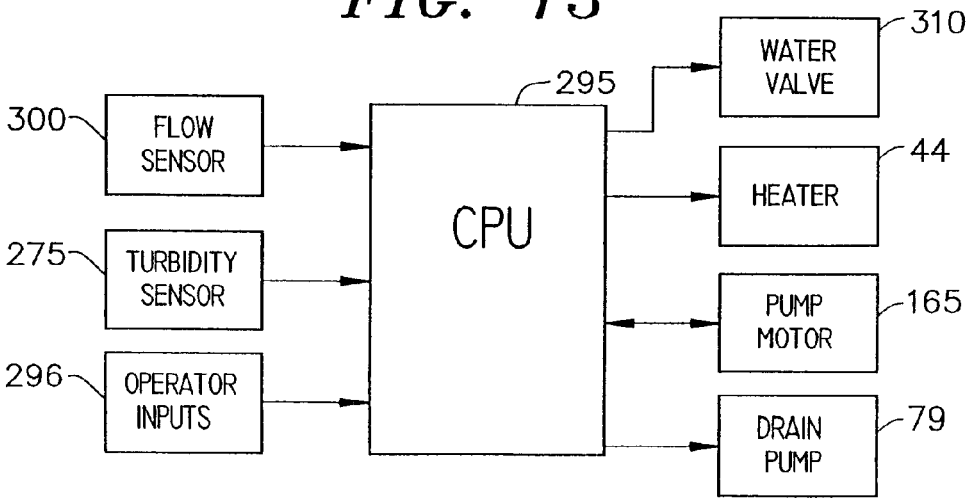
FIG. 13 is a block diagram of a control unit for the dishwasher.

Obviously, dishwasher 2 needs to perform various operations in connection with a washing cycle wherein heater 44, drain pump 79 and pump motor 165 are controlled. FIG. 13 schematically illustrates the control system used to regulate dishwasher 2 in the manner set forth above through a controller or CPU 295 based on operator inputs made at a control panel, as generically represented at 296, and signals from turbidity sensor 275, which also includes the thermistor as discussed above, provided in tub 5 outside of pump assembly 30. In addition, the invention employs the use of a flow sensor, generally indicated at 300, which is arranged in an upper portion of overflow tube 98. Flow sensor 300 is provided to signal when fluid reaches the upper portion of overflow tube 98, thereby indicating that fine mesh filter screen 207 is clogged. At this point, it should be realized that flow sensor 300 can be defined by a wide range of known sensors, but is preferably constituted by a pair of space electrical contacts arranged within overflow tube 98 and across which a circuit is completed when washing fluid is present. In any event, flow sensor 300 is used in accordance with the invention to signal the need for even further draining or purging operations. For instance, if overflow tube 98 is utilized with overflow housing 104 and coarse filter 106 as described above, an indication of washing fluid in overflow tube 98 for a predetermined period of time, say 15 seconds, would be used to initiate at least an additional, partial drain. On the other hand, the presence of flow sensor 300 actually enables overflow housing 104 and coarse filter 106 to be excluded and/or the height of overflow tube 98 to be substantially reduced in the overall system. In any case, whenever fluid is sensed in the uppermost portion of overflow tube 98 by flow sensor 300 during a washing operation, a drainage operation would be initiated in order to at least purge collection chamber 212 of soil and enable cleansing of fine mesh filter screen 207 as set forth above.

Of interest in connection with either of these sensing arrangements is that employing overflow tube 98 and flow sensor 300 avoids the need for other, rather expensive and more complicated sensing arrangements, such as a pressure sensor, for pump assembly 30. However, when a drain or purging operation is performed, it is preferred in accordance with the present invention to further sense termination of the operation. To this end, FIG. 13 depicts a bi-directional arrow between pump motor 165 and CPU 295. This illustration represents a sensing arrangement of the motor current. More specifically, when enough washing fluid and soil is pumped into drain hose 85 during a drain operation such that fine mesh filter screen 207 has been purged of its food soil as evidenced by the fluid level in overflow tube 98 dropping back down to a normal wash level, motor 165 will begin to starve. This condition is relayed to CPU 295 by a drop in motor current. At this time, a water valve 310 is energized to replace lost water. The motor current is preferably, continually sensed during this period to determine when enough water has been added. Therefore, it should be noted that the motor current can be used to signal the need to stop pump motor 165, start drain pump 79, control water valve 310 and restart pump motor 165.

Based on the above description, it should be readily apparent that the present invention enables the number, sequencing, and duration of unscheduled drain or purging operations to be adapted to dynamic characteristics of each individual wash cycle based on signals from each of sensors 275, 300 and pump motor 165. Although described with reference to preferred embodiments of the invention, it should be readily understood that various changes and/or modifications can be made to the invention without departing from the spirit thereof. For instance, it is possible to avoid the use of turbidity sensor 275 entirely, thereby just relying on timed and flow sensor based drain operations. In addition, motor current need not be sensed if a pre-programmed drain sequencing algorithm is employed. Even though such an arrangement could still define an overall system which is responsive to dynamic characteristics due to the inclusion of flow sensor 300, the most preferred embodiment of the invention makes use of turbidity sensor 275 and motor current signals as well. In any event, it should be understood that the invention is only intended to be limited by the scope of the following claims.

We claim:

1. A dishwasher comprising:

a tub having bottom, opposing side, rear and top walls which collectively define a washing chamber adapted to receive and cleanse soiled kitchenware;

at least one wash arm for spraying washing fluid onto kitchenware placed into the washing chamber;

a pumping unit, including a motor, for directing washing fluid to the at least one wash arm;

a filter chamber, adapted to receive a portion of the washing fluid, for entrapping soil from the washing fluid while permitting cleansed washing fluid to be directed back into the washing chamber;

a drain exposed to the filter chamber;

means for sensing a plurality of dynamic operating parameters of the dishwasher, with the plurality of dynamic operating parameters including at least one fluid dynamic operating parameter and a current of the motor; and means for performing both an unscheduled drain operation, based on the plurality of dynamic operating parameters, and at least one timed drain operation for the dishwasher during an overall dishwashing cycle.

2. The dishwasher according to claim 1, wherein the means for sensing includes a flow sensor for sensing the at least one fluid dynamic operating parameter.

3. The dishwasher according to claim 2, wherein the means for sensing further includes a turbidity sensor for determining a soil level in the washing fluid.

4. The dishwasher according to claim 2, further comprising: an overflow tube leading upwardly from the filter chamber such that washing fluid can rise within the overflow tube upon collection of soil in the filter chamber, wherein the flow sensor signals a presence of washing fluid in the overflow tube.

5. The dishwasher according to claim 4, further comprising: a filter unit provided atop the overflow tube.

6. The dishwasher according to claim 5, wherein the filter unit includes a housing enclosing a filter.

7. The dishwasher according to claim 1, further comprising:

a water valve for introducing water into the tub; and means for opening the water valve subsequent to initiation of at least one of the unscheduled and timed drain operations and closing the water valve based on a change in the current of the motor.

8. The dishwasher according to claim 7, further comprising: a drain pump, separate from the pumping unit, connected to the drain, said drain pump being operated through the controller during the drain operation.

9. The dishwasher according to claim 1, wherein the means for sensing includes a turbidity sensor for determining a soil level in washing fluid within the tub.

10. A method of operating a dishwasher comprising:

drawing washing fluid from within a washing chamber defined in a tub of the dishwasher into a pump housing;

pumping the washing fluid to at least one wash arm for spraying onto kitchenware being washed in the dishwasher;

filtering soil from the washing fluid;

sensing at least one fluid dynamic operating parameter of the dishwasher; and both initiating and terminating an unscheduled drain operation for the dishwasher based on the at least one fluid dynamic operating parameter and pump motor current.

11. The method of claim 10, wherein the at least one fluid dynamic operating parameter include washing fluid flow and washing fluid soil level.

* * * * *